United States Patent [19]

Throne

[11] 4,095,336

[45] Jun. 20, 1978

[54] COMB MEANS FOR CONNECTING STATION

[75] Inventor: James D. Throne, Maple Grove, Minn.

[73] Assignee: Minnesota Mining and Manufacturing Company, St. Paul, Minn.

[21] Appl. No.: 830,852

[22] Filed: Sep. 6, 1977

[51] Int. Cl.[2] ..... H01R 43/04

[52] U.S. Cl. ..... 29/749; 29/566.3

[58] Field of Search ..... 29/566.3, 566.4, 749, 29/750, 751

[56] References Cited

U.S. PATENT DOCUMENTS

| | | | |
|---|---|---|---|
| 3,886,641 | 6/1975 | Davis | 29/749 X |
| 3,953,916 | 5/1976 | Rolland et al. | 29/566.3 |
| 3,965,558 | 6/1976 | McKee | 29/749 |
| 3,972,101 | 8/1976 | Casey et al. | 29/749 |

*Primary Examiner*—Carl E. Hall

*Attorney, Agent, or Firm*—Cruzan Alexander; Donald M. Sell; Temple Clayton

[57] ABSTRACT

Comb means for continually directing a multiplicity of wires to the connecting station of a multiwire connecting apparatus for locking a multiplicity of wires in a multiwire connector.

1 Claim, 3 Drawing Figures

COMB MEANS FOR CONNECTING STATION

This invention relates to comb means for continually directing a multiplicity of wires to the station of an apparatus for actuating the locking action of wire connectors and particularly multiwire connectors. In some modes of operating using the comb means of the invention the wires are continuous through several connectors and in other modes each wire is terminated with the mounting of a connector.

In U.S. Ser. No. 639,219 and 630,220, filed on Nov. 10, 1975, and assigned to the Assignee of the present application, are described connectors for multipair cable terminations having wire stripping contact elements. The connectors are in both male and female forms having respectively a central rib and central recess. In each case the connector comprises a body having multiple contact elements in parallel wire channels to which wires of the cable are connected, and a cover which engages the body and assures secure connection of each wire to the correct contact member. The connectors are particularly of use with telephone cables which in United States practice are regularly 25 pairs of 24 or 26 AWG (American Wire Gauge) wire. In using these connectors or cable terminations, wires are loosely attached to each of the fifty contact members and then secured by urging the cover into engaging position while cutting away end portions of the several wires.

In U.S. Ser. No. 735,172, filed Oct. 26, 1976, now abandoned and the continuation-in-part thereof U.S. Ser. No. 830,853, filed of even date herewith is described an apparatus for connection of multiple wire pairs in the connectors described above. It is found that this apparatus is adaptable to use with various types of connectors for various purposes including non-terminal connectors and can be used with a multiplicity of wires which are not bound into cables.

It is a principal object of this invention to provide comb means for directing a multiplicity of individual wires and wire pairs into connectors in predetermined sequence. Other objects will be evident elsewhere herein.

It is found that useful comb means for directing a multiplicity of individual wires and wire pairs into connectors in predetermined sequence consists essentially of a support frame, slideably engageable with grooves in the supply side of the connector receiving station and bearing a wire guide with a multiplicity of holes, preferably in two staggered rows, and wire gathering means for decreasing the angle at which wires enter the holes of the wire guide.

Comb means are now provided for temporarily retaining multiple individual wires in connective relationship to a connector body while the cover of the connector is forced into interlocking relationship thereto. In broad terms the apparatus in which the comb means of the invention is employed for attachment of connectors to multiple wires in pairs comprises a base having a longitudinal axis, a connector receiving station on the base having a supply side and a product side and comprising a receptacle for a connector, receiving position for the comb means of the invention on one side of said station, means in the base for elevating the connector receiving station with respect to the base, and arm means rotatable about the axis of the base from a horizontal position to a position immediately above the connector receiving station and comprising anvil means positioned to contact a connector in the receptacle of the connector receiving station when the connector's cover is in position and the connector receiving station is elevated.

Elevation of the connector receiving station may be by any convenient means. Plungers on the under side of the connector receiving station may be activated by manually or mechanically operated cams in the base or pneumatically by compressed air or hydraulically by water or oil.

The receptacle of the connector receiving station is conveniently positioned on posts in a channel in the connector receiving station, the posts being of different diameters and the receptacle being hermaphroditic in that it adapts by reversal to both male and female connectors. Receptacles of different sizes may be employed for connectors of different sizes.

The arm means is conveniently a U-shaped piece with suitably shaped anvil means which may include a knife blade mounted on it when wires are to be connected to only one connector. The blade may be replaced by a blank plate or omitted when many connectors are connected in parallel. The arm means conveniently includes indexing means such as click stops to position it correctly over the connector receiving station. Desirably the anvil means or crimping bar is profiled to engage the cover or lid of the connector and thereby also, when it is not desired to attach several connectors to a length of cable without cutting the wires, orienting the knife blade to cut wire ends substantially flush at the side of the connector.

The invention is further described by reference to the drawings wherein

Figure 1:
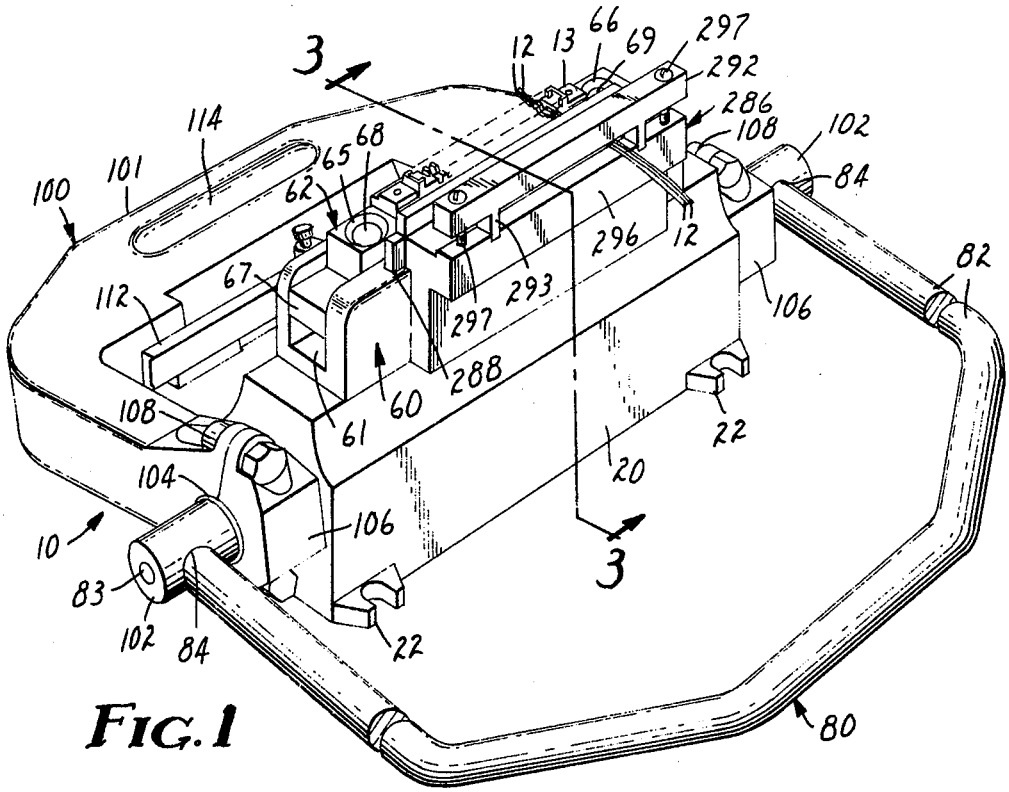
FIG. 1 is a perspective view of the front of a multiple wire connecting apparatus in an open position of the relatively movable parts and comprising the comb means of the invention.
Figure 2:
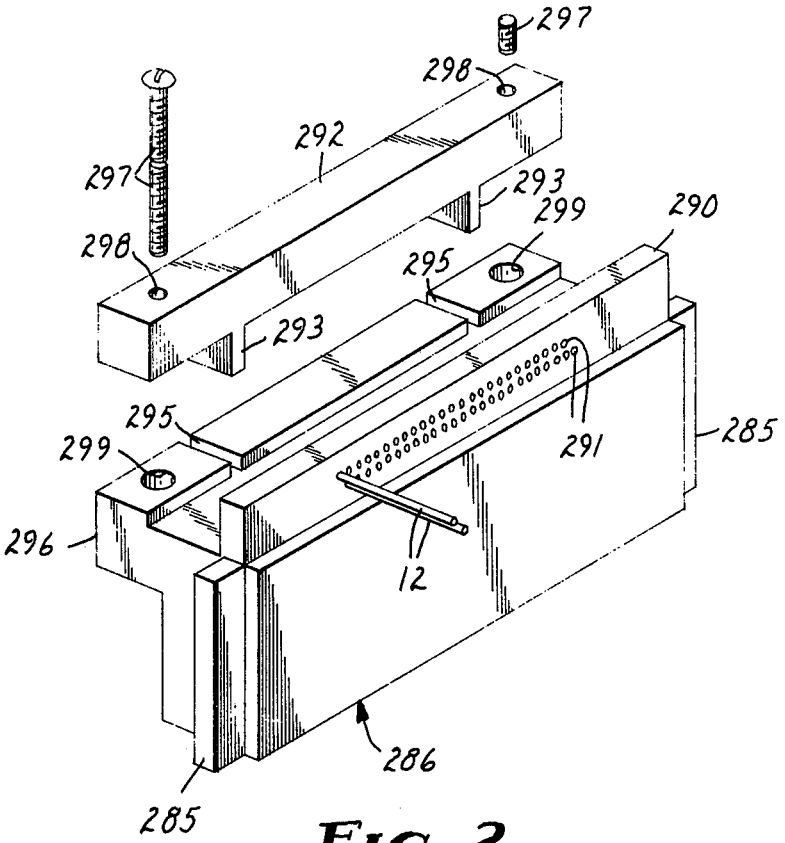
FIG. 2 is a perspective partially exploded view of the comb means of the invention.
Figure 3:
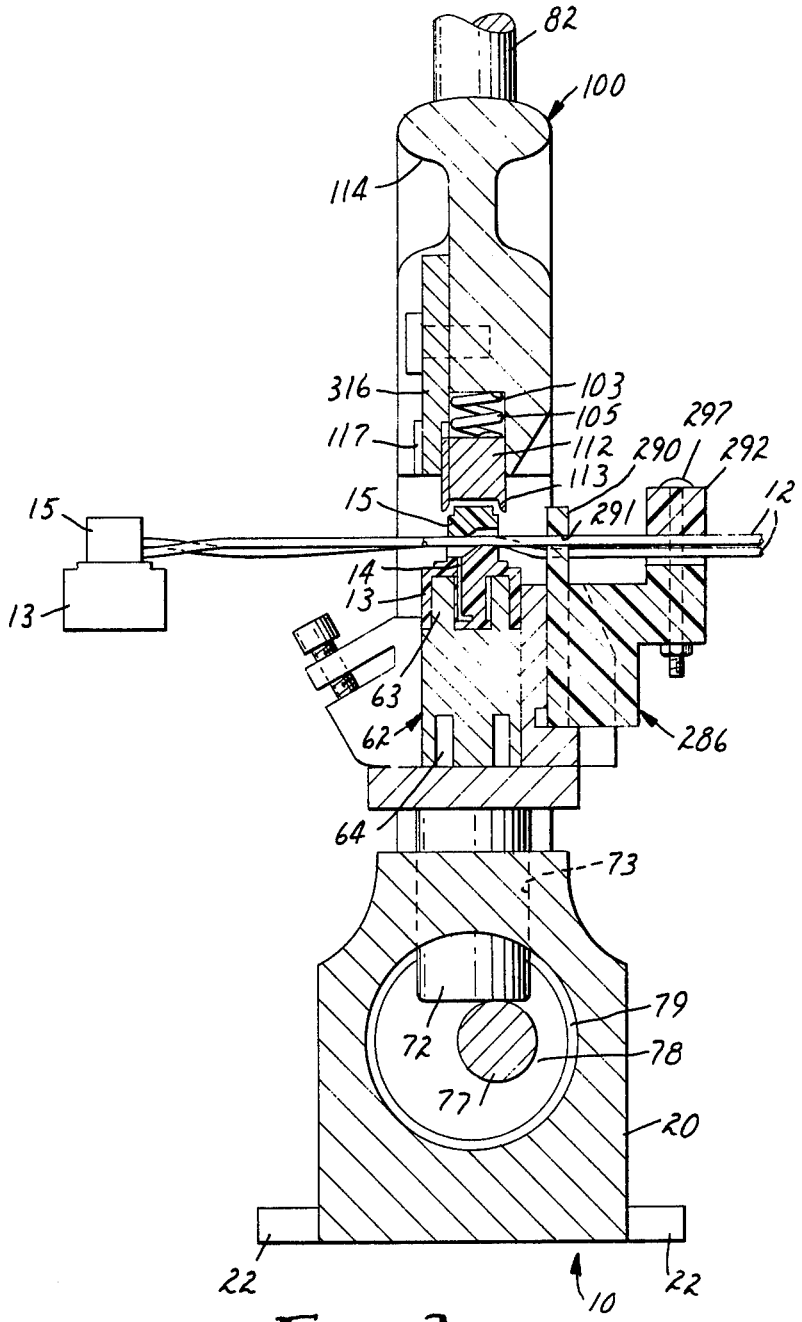
FIG. 3 is an enlarged sectional view taken along line 3—3 of FIG. 1 with movable parts in an intermediate position and wires partly connected.

Referring to the drawings and particularly FIGS. 1–3 there is shown a comb means of the invention and the manner in which it cooperates to attach wires to a cable connector. The cable connecting apparatus, generally designated 10 is employed for connecting multiple pairs of insulated wires 12 to a connector 13 including a plurality of spaced parallel contacts 14 and cover lid 15.

Connecting apparatus 10 as shown in FIGS. 1–3 includes as parts a generally rectangular base 20, means 80 for elevating the connector receiving station 60, and arm means 100 rotatable about the base to a position above the connector receiving station. Base 20 includes lugs 22 for attachment, if desired, to a work table or other such support.

Connector receiving station 60, which is of generally rectangular shape, is provided on the upper side with channel 61 for receiving reversible hermaphrodite receptacle 62 for a connector 13. The receptacle is seen to possess end tabs 67, a male recess 63 for reception of a female connector and female recess 64 for reception of a male connector. Receptacle 62 engages in channel 61 with mating of cylindrical posts 68 in beveled opening 65 and cylindrical post 69 in beveled opening 66. The differences in sizes of post 68 and 69 assures proper orientation of receptacle 62. The under side of receiving station 60 is attached to two cylindrical plungers 72 of which one is shown which extend through holes 73 in base 20.

Connector receiving station 60 is movably attached in channel 61 of base 20 by spring return means (not shown) and fastened to eccentric cam rod 77 eccentrically mounted in bearing cams 78 which is brushed with bushings 79 in the ends of base 20. The tension in the spring return means (now shown) is sufficient to urge connector receiving station 60 toward base 20 but movable with respect thereto by action of cam rod 77 against plungers 72 as bearing cam 78 is rotated by handle 82 fastened by set screws 83 in holes 84 through bearing cam 78.

Comb means of the invention 286 is positioned on the front of the apparatus for guiding multiple insulated wires 12. Comb means 286 has tongues 285 at the ends fitting grooves 288 in connector receiving station 60, includes wire guide 290 with two rows of staggered holes 291 of a size to pass wires readily through which members of each pair of wires are threaded, one through the upper hole, the other through the next lower hole as seen in FIG. 1. Comb means 286 further includes wire gathering means 292 with lugs 293 engaging grooves 295 in extension 296 of comb means 286 and to which wire gathering means 292 is attached by screws 297 passing through holes 298 in wire gathering means 286 and holes 299 in extension 296.

Arm means 100 includes arm 101 of a general U-shape having finger grip recess 114 in the base of the arm 101 rotatably mounted on projections 102 of bearing cams 78 with bushing 104 by means of arm cap 106 bolted to arm 101 by bolts 108. Arm 101 includes click stop means (not shown), anvil means or crimping bar 112 secured by screws (not shown) and movable in recess 103 against spring loads 105 set in cavities in arm 101. Retaining plate 316 is attached to arm 101 and fits between guides 117 attached to crimping bar 112 and movable therewith. The contacting surface of crimping bar 112 is profiled 113 for proper contact with the lid 15 of connector 13.

In use the cable terminating apparatus of the invention may conveniently be attached to a work surface such as a work bench by bolts or screws in lugs 22. Wires are brought from suitable supply rolls (not shown) and threaded through holes 291 as pairs which may be color coded as desired and then positioned in the respective positions of connector 13 in the receptacle 62. Lid 15 is positioned, arm 100 positioned above the connector and lid and handle 82 rotated to engage lid 15 on connector 13 and make wire connections. The station is cleared by returning handle 82 and arm 100 to open positions and a second connector is positioned as illustrated in FIG. 3 and the operation repeated. If desired a guillotine blade (not shown) may be inserted in place of retaining plate 316 for the first connector in a sequence, or ends of wires can be trimmed with wire cutters. As many connectors as desired may be connected in parallel with assurance that all positions will be connected in the same sequence.

I claim

1. In an apparatus for attachment of connectors to multiple wire pairs comprising:

a base having a longitudinal axis, a connector receiving station on said base having a supply side and a product side and comprising a receptacle for a connector, means in said base for elevating said connector receiving station with respect to said base and arm means rotatable about the said axis of said base from a horizontal position to a position immediately above said connector receiving station, said arm means comprising anvil means positioned to contact a connector in said receptacle of said connector receiving station when said connector is covered and said connector receiving station is elevated, the improvement consisting of comb means mounted on the supply side of said connector receiving station said comb means having a body with tongues for engagement with grooves in said connector receiving station, a wire guide with two rows of staggered holes of a size for allowing the wires of said multiple wire pairs to readily pass through, and an extension on said body bearing wire gathering means.

* * * * *